US011622205B2

(12) United States Patent
Högberg et al.

(10) Patent No.: US 11,622,205 B2
(45) **Date of Patent: *Apr. 4, 2023**

(54) ACTIVATING A MODE OF A HEARING DEVICE

(71) Applicant: SONOVA AG, Staefa (CH)

(72) Inventors: Jonas Högberg, Uerikon (CH); Michael von Tessin, Esslingen (CH); Ivo Spieler, Stäfa (CH); Daniel Lucas-Hirtz, Rapperswil (CH); Jan Mattmuller, Effretikon (CH)

(73) Assignee: Sonova AG, Staefa (CH)

( * ) Notice: Subject to any disclaimer, the term of this patent is extended or adjusted under 35 U.S.C. 154(b) by 0 days.

This patent is subject to a terminal disclaimer.

(21) Appl. No.: 17/502,927

(22) Filed: Oct. 15, 2021

(65) Prior Publication Data

US 2022/0038829 A1 Feb. 3, 2022

Related U.S. Application Data

(63) Continuation of application No. 16/633,598, filed as application No. PCT/EP2017/070292 on Aug. 10, 2017, now Pat. No. 11,206,497.

(51) Int. Cl.
*H04R 25/00* (2006.01)

(52) U.S. Cl.
CPC ..... *H04R 25/43* (2013.01); *H04R 25/554* (2013.01); *H04R 25/558* (2013.01); *H04R 25/602* (2013.01); *H04R 2225/55* (2013.01); *H04R 2225/61* (2013.01)

(58) Field of Classification Search
CPC ..... H04R 2225/55; H04R 2225/61; H04R 25/43; H04R 25/554; H04R 25/558; H04R 25/602
USPC ..... 381/315
See application file for complete search history.

(56) References Cited

U.S. PATENT DOCUMENTS

| | | | |
|---|---|---|---|
| 9,161,138 | B2 | 10/2015 | Pedersen |
| 10,674,590 | B2 | 6/2020 | Hirashita |
| 2011/0249836 | A1 | 10/2011 | Solum |
| 2014/0087675 | A1 | 3/2014 | Pedersen |
| 2015/0172831 | A1 | 6/2015 | Dttberner |
| 2016/0330537 | A1 | 11/2016 | Barrentine |

FOREIGN PATENT DOCUMENTS

| | | |
|---|---|---|
| EP | 2712210 | 3/2014 |
| EP | 2819436 | 12/2014 |
| WO | 2019029810 | 2/2019 |

OTHER PUBLICATIONS

"International Search Report and Written Opinion received in International Application No. PCT/EP2017/070292, dated Apr. 12, 2018.".

*Primary Examiner* — Phylesha Dabney
(74) *Attorney, Agent, or Firm* — ALG Intellectual Property, LLC

(57) ABSTRACT

The disclosed technology generally relates to operation modes for hearing devices. In some implementations, the disclosed technology includes a hearing device entering into and operating in an airplane mode or a mode of operation that limits communication with a select frequency or select group of frequencies. To enter a mode of operation, a user may use two inputs for the hearing device. For example, one input may be a battery closing and another input may include the pushing of a button on a device (e.g., on the hearing device or a mobile device in communication with the hearing device).

18 Claims, 2 Drawing Sheets

ACTIVATING A MODE OF A HEARING DEVICE

RELATED APPLICATIONS

The present application is a continuation of U.S. patent application Ser. No. 16/633,598, filed on Jan. 24, 2020, which is a U.S. National Stage Application under 35 U.S.C. § 371 of International Application No. PCT/EP2017/070292, filed on Aug. 10, 2017, the contents of which are hereby incorporated by reference in their entirety.

BACKGROUND INFORMATION

Electronic devices that send or receive wireless communication signals are prohibited in some situations. For example, electronic devices are prohibited from receiving or transmitting wireless communication signals on airplanes during flight. To make electronic devices comply with this requirement, device manufacturers created airplane mode. Airplane mode is a setting on smartphones and other mobile devices (e.g., tablets) that prevents a device from intentionally emitting radio energy. Because smart phones have easily accessible user interfaces, users can enter or exit airplane mode with ease. However, other devices such as hearing devices, lack an effective user interface for entering or existing airplane mode.

Another reason hearing aids lack an effective user interface for entering airplane mode is because these devices are getting smaller for cosmetic reasons. As the hearing aids are reduced in size, the available area for user interface controls is getting smaller, in particular for in-the-ear hearing aids, and as a result there is not sufficient space for further user controls. Additionally, hearing aids have traditionally lacked the ability to communicate wireless, and thus there was no need for airplane mode.

One solution for enabling a hearing device with airplane mode is U.S. Pat. No. 9,161,138 ("Pedersen"). Pederson discloses a technology for a head-worn device entering airplane mode, where airplane mode includes prohibiting a device from transmitting and receiving any wireless signals. The head-worn device can be engaged in airplane mode for an entire flight. Although Pedersen discloses a method for a hearing aid to operate in airplane mode, Pedersen's solution is not convenient because it requires the user to turn off all wireless transmission and reception functions for the hearing aid. Accordingly, a need exists to improve the technology and provide additional benefits.

BRIEF DESCRIPTION OF THE DRAWINGS

The disclosed technology and accompanying figures are used for illustrative purposes.

Figure 1:
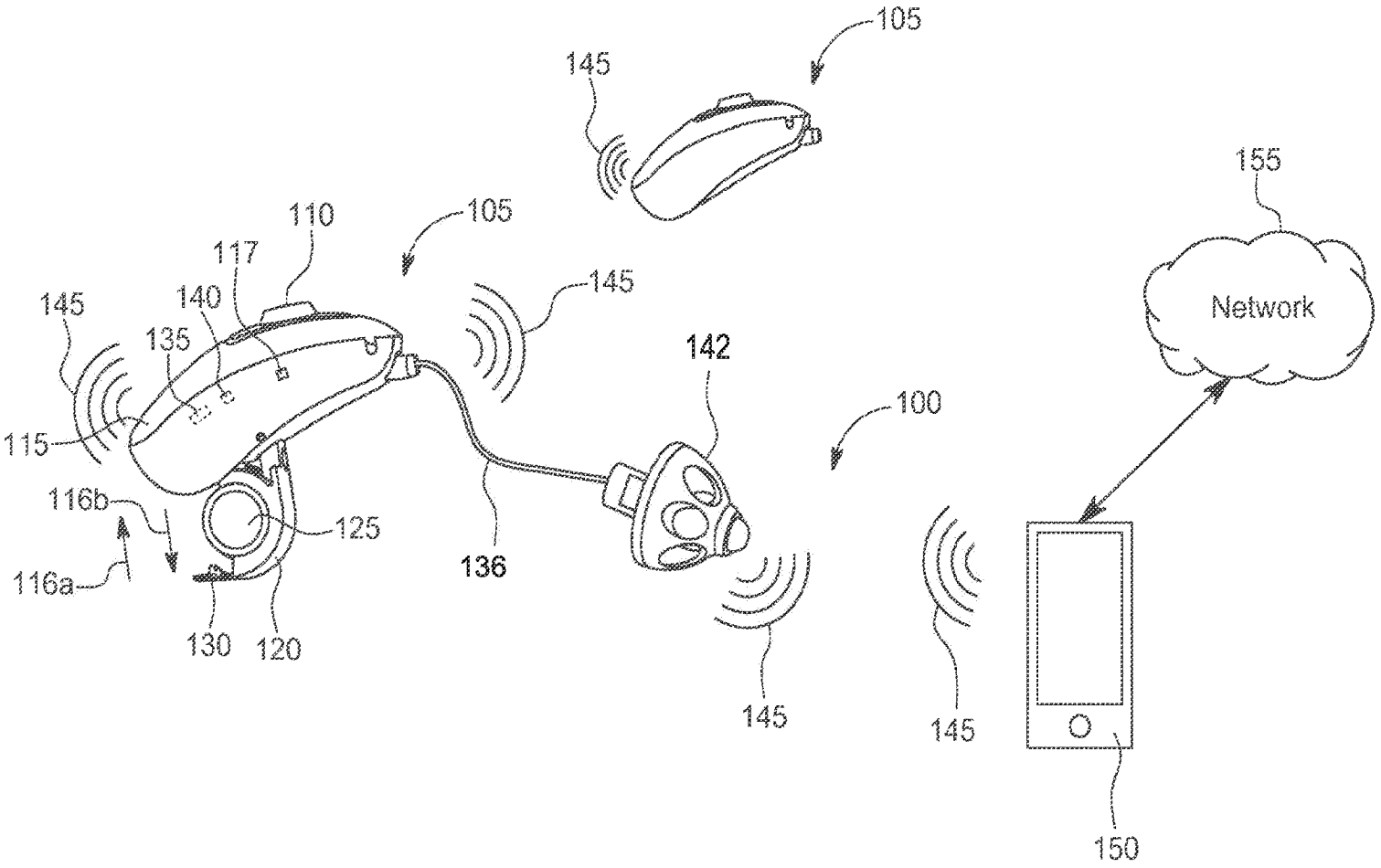
FIG. 1 illustrates a communications environment in accordance with some implementations of the disclosed technology.

The drawings have not necessarily drawn to scale. Similarly, some components or operations can be separated into different blocks or combined into a single block for the purposes of discussion of some of the implementations of the present technology. Moreover, while the disclosed technology is amenable to various modifications and alternative forms, specific implementations have been shown by way of example in the drawings and are described in detail below. The intention, however, is not to limit the disclosed technology to the particular implementations described. On the contrary, the disclosed technology is intended to cover all modifications, equivalents, and alternatives falling within the scope of the disclosed technology as defined by the claims.

DETAILED DESCRIPTION

The disclosed technology relates to gestures that cause a hearing device to enter a mode of operation. In some implementations, the mode of operation prevents the hearing device from wirelessly communicating on all frequencies; and in some implementations, the mode of operation limits the hearing device to wirelessly communicating with a select frequency or a select group of frequencies (also referred to as "reduced frequency mode").

In some implementations, the disclosed technology requires two gestures to enter airplane mode. For example, a hearing device enters airplane mode based on receiving two input in order: a first input is a battery door closing and the second input is a user pushing a user input button on the hearing device. If the first and second inputs are received by the hearing device and the second input is received within 3 minutes of the first input, the hearing device enters airplane mode.

In addition to airplane mode, the disclosed technology also includes a mode of operation that limits hearing device wireless communication to a select frequency or select group of frequencies. A hearing device manufacture can determine the select frequency or select group frequencies based on design specifications for the hearing device. For example, a hearing device operating in a reduced frequency mode based on receiving two input signals, wherein one input signal is a battery door closing and another input signal is the hearing device receiving a signal from a mobile phone in communication with the hearing aid. Reduced frequency mode prohibits the hearing device from transmitting wireless communication signals in Bluetooth™ of Wi-Fi™ frequencies (e.g., 2.4 GHz) and enables the device to transmit or receive signals on other frequencies (e.g., 10 to 50 MHz). Hearing device users may prefer to turn off Bluetooth™ of Wi-Fi™ communication and keep near field communication so that one hearing aid can communicate to another hearing aid (e.g., 10 to 50 MHz) even during flight.

The disclosed technology has at least one benefit in some implementations. For example, the disclosed technology enables a user to use only two inputs a single time to enter flight mode. Because a hearing device has a limited user interface, these simple gestures allow for a satisfying user experience. Another benefit of the disclosed technology is that a user enables his or her hearing device to communicate with another hearing device even during flight because the hearing device can use frequency ranges other than those restricted by the airplane or an organization.

Table 1 below discloses a few definitions for the disclosed technology. These definitions are controlling for the entire document unless another part of the document explains how the term differs from these definitions.

TABLE 1

Definitions of Some Terms

| Term | Definition |
|---|---|
| A hearing device | is a device that provides audio to a user; some example hearing devices include a hearing aid, headphones, earphones, assisted listening devices, or any combination thereof; and hearing devices include both prescriptiondevices and non-prescription devices configured to be worn on a human head. |
| A hearing device component | is a component coupled to a hearing device; some example hearing devicecomponents include cerumen protection, battery door, microphone, processor, housing, or sound tube. |
| A heading aid or hearing protection | is a device that provides amplification or attenuation of protection audio signals to compensate for hearing loss or attenuation functionalities; some example protection hearing aids include a Behind-the-Ear (BTE), Receiver-in-the-Canal RIC, In-the-Ear (ITE), Completely-in-the-Canal (CIC), or Invisible-in-theCanal (IIC) hearing aids. |
| Airplane Mode | is a mode of operation that prevents a device from transmitting or receiving wireless communication signals; however, a device can still perform other operations such as sound modification while in airplane mode. Airplane mode is also referred to as "flight mode". In general, airplane mode prohibits Wi-Fi and Bluetooth communication, which operate frequencies from 2.39 GHz to 2.486 GHz, including 2.4 GHz. |
| Reduced Frequency Mode | is a mode of operation that causes a device to not transmit wireless communication signals on one frequency or within a range of frequencies. |
| Operation mode | is a mode of operation for a device. A first mode of operation can be a normal mode of operation. A second mode of operation can be an airplane mode or a reduced frequency mode. |
| Gesture | an action, motion, or input that transmits a signal to a hearing device. A single gesture or multiple gestures can modify the operation of a hearing device. |

FIG. 1 illustrates a communications environment 100 in accordance with some implementations of the disclosure. The communications environment 100 includes hearing devices 105, a mobile device 150, and a network 155. Although the hearing devices 105, the mobile device 150, and the network 155 are shown in the communications environment 100, the communications environment 100 can also include multiple hearing devices 105 or a single hearing device 105, multiple mobile devices 150, and multiple networks 155. Each of these components is described in more detail below.

The hearing device 105 includes several components to provide audio information to a user. The hearing device 105 includes a user input 110, a housing 115 to protect the hearing device 105, a microphone 117 (shown schematically), a battery door 120 configured to open and close, a battery 125 (e.g., rechargeable battery, zinc-air, disposable) to power the hearing device 105, a closing member 130, a tube 136 (e.g., to transmit audio signals or sound waves), and a receiver 142. The battery door 120 is configured to move as shown by the bolded arrows 116*a* and 116*b*. For example, the battery door 120 is coupled to housing 115 by hinge, screw, or pivoting component. In some implementations, a user can push, pull, or use the closing member 130 as a lever to close or open the battery door 120 of the hearing device 105. In some implementations, the hearing device 105 generates a clicking sound from the battery door 120 closing to indicate the battery door 120 is securely (e.g., locked) closed as a result of a mechanical movement. The receiver 142 can be a transducer (e.g., speaker) that provides sound to a user wearing the hearing device 105.

The hearing device 105 can communicate with other devices or a network using the antenna 135 and the processor 140. The antenna 135 is at least partially electrically conductive member that can transmit and receive electromagnetic radiation. In some implementations, the antenna 135 is an antenna enable to configured to implement Bluetooth™, ZigBee™, or another 802.11 IEEE standard for wireless communication. Although the antenna is shown as being in the hearing device 105, the antenna can be outside of the hearing device 105 (e.g., attached to the hearing device outside of the housing). The antenna 135 is configured to electronically communicate with the processor 140. The processor 140 can be a microcontroller, field-programmable gate array (FPGA), application specific integrated circuit (ASIC), or other processing device. The processor 140 can include a single chip or multiple chips (e.g., a chip set) to process, transmit, and send wireless communications. The processor 140 can also cause the hearing device 105 to enter or exit a mode of operation (e.g., turn on, turn off, turn on airplane mode, turn off airplane mode). In some implementations, the process 140 is transmitting or receiving "control signals" that are instructions or signals that cause a device to perform an operation.

As shown by wireless communication signals 145, the hearing devices 105 can transmit or receive the wireless communication signals 145. For example, the hearing devices 105 can receive streaming audio information from the mobile device 150. The hearing devices 105 can also communication with each other. The hearing devices 105 can communicate with each other using one frequency (e.g., 10 to 50 MHz) and communicate with other devices using a different frequency (e.g., 2.4 GHz). In some implementations, the hearing devices 105 or a single hearing device 105 can communicate with a voice-recognition device such as a smart phone that has Siri™ or Google Voice™. The hearing device 105 can behave as a relay for another hearing device 105 so that the mobile device 150 communicates with only one of the hearing devices 105.

As illustrated in FIG. 1, the communications environment 100 includes one or more mobile devices 150. The mobile device 150 can be a mobile phone, smart phone, tablet computer, mobile media device, mobile gaming device, virtual or augmented reality headset, vehicle-based computer, wearable computing device, or portable electronic device. In some implementations, the mobile device 150 includes software or a mobile application that controls or communicates with the hearing device 105. The software or mobile application can configure the hearing device 105 by modifying software or firmware on the hearing device 105, changing a mode of operation on the hearing device 105, or collecting and analyzing data associated with the hearing device 105 and then modifying the hearing device 105 based on the collected and analyzed data. The mobile device 150 can include a graphical user interface (e.g., touch screen) where a user can input information or receive information and send control signals to the hearing devices 105.

As described in more detail below in FIG. 2, a user can push, toggle, or use the mobile device 150 as a second user input for entering or controlling a mode of operation for the hearing device 105. For example, a user can push a touch-screen of a smart phone device using a hearing aid mobile application installed on the smart to instruct the hearing aid to enter airplane mode or reduced frequency mode.

Continuing with FIG. 1, the mobile device 150 can also communication with the network 155. In some implementations, the mobile device 150 serves to communicate information from the network 155 to the hearing device 105. For example, the mobile device 150 can transmit audio information available on the Internet or Cloud for use with the hearing device 105. In some cases, the network 155 comprises multiple networks, even multiple heterogeneous networks, such as one or more border networks, voice networks, broadband networks, service provider networks, Internet Service Provider (ISP) networks, and/or Public Switched Telephone Networks (PSTNs), interconnected via gateways operable to facilitate communications between and among the various networks. The network 155 can also include third-party communications networks such as a Global System for Mobile (GSM) mobile communications network, a code/time division multiple access (CDMA/TDMA) mobile communications network, a 3rd or 4th generation (3G/4G) mobile communications network (e.g., General Packet Radio Service (GPRS/EGPRS)), Enhanced Data rates for GSM Evolution (EDGE), Universal Mobile Telecommunications System (UMTS), or Long Term Evolution (LTE) network), or other communications network.

Figure 2:
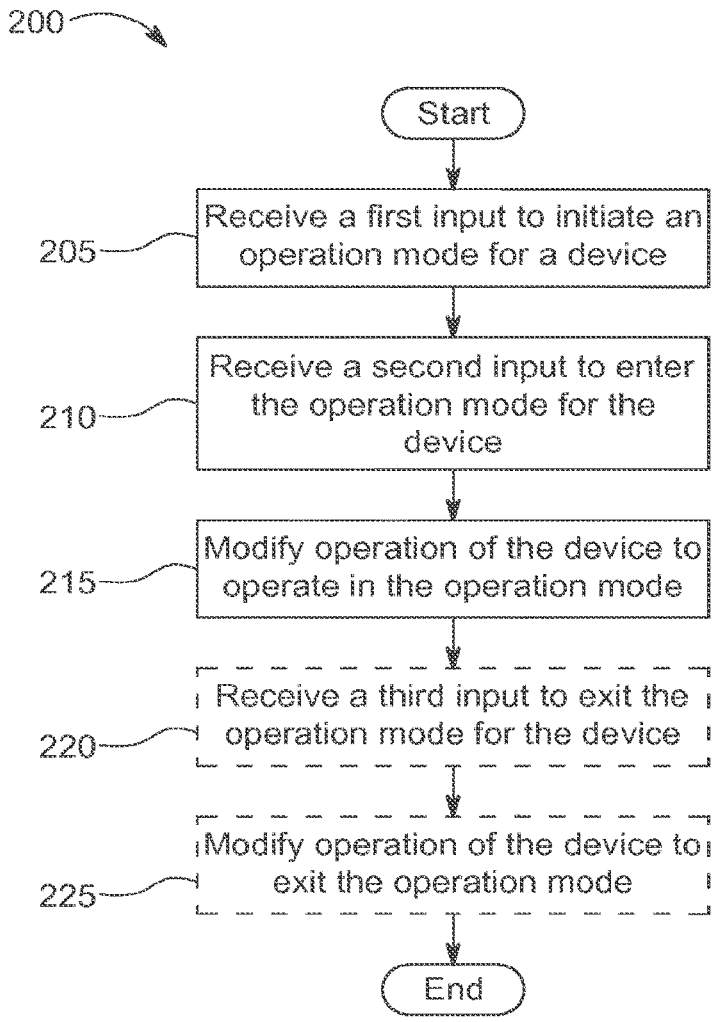
FIG. 2 illustrates a set of operations for operating a hearing device in accordance with some implementations of the disclosed technology.

FIG. 2 illustrates a set of operations for operating a hearing device in accordance with some implementations of the disclosure. The process 200 includes operations for entering into or exiting from a mode of operation for the hearing device 105. In some implementations, the process 200 enables the hearing device 105 to enter airplane mode. In other operations, the process 200 enables the hearing device 105 to enter a mode of operation where it can transmit or receive signals on some frequencies, but not other frequencies (e.g., it can transmit frequencies on the MHz and not GHz). This is mode is also called "reduced frequency mode" because the hearing device operates using at least one less frequency when in reduced frequency mode. The process 200 can begin uses a first input such as closing the battery door for a hearing aid, pushing the user input for a predetermined period of time, or when a user a mobile device in communication with the hearing device to enter operation.

At operation 205, a device receives a first input to initiate an operation mode for a device. The first input can be: turning on the hearing device (e.g., closing the battery door), modifying a physical button on a device (e.g., pushing or turning a button), modifying a remote button (e.g., open, closing, or sliding a virtual button on a mobile phone), or receiving a signal from a remote graphical user interface. For example, the first input is a user closing the battery door 120 (FIG. 1) a single time or multiple times (e.g., three times). The first input may not require a complete opening and closing of the battery door; rather, the first input can require a partial opening or a partial closing. To open or close a battery door, a user can push or pull the closing member 130 to apply mechanical pressure to the latch or lock for the battery door 120 to the housing 115 of the hearing aid 115.

In some implementations, the first input may be automatically generated. For example, the first input can be generated when the hearing device 105 is turned on, and in some implementations the first input can be continuously active for an extended period of time (e.g., 2 to 3 minutes after the hearing device has turned on).

At operation 210, the hearing device receives a second input to enter the operation mode for the device. Similar to the first input, the second input can be: modifying a physical button, receiving a signal from a sensor unit coupled to the hearing device, modifying a dial, modifying a remote button, modifying a remote graphical user interface, or modifying a button on a touch screen for a mobile device. For example, the second input can be closing a battery door and the second input can be a user pushing the user input 110 (FIG. 1) for extended period (e.g., between 5-20 seconds and preferably from 8-15 seconds, and more preferably from 8-11 seconds). A longer push (e.g., 7 or more seconds) can be preferred to a shorter push (e.g., less than 7 seconds) because a hearing device use does not want to enter flight mode accidentally.

The first input can be short or long depending on how a manufacturer or user wants to program the circuit. The first input can require a user to close a batter door or push a button for at least 8 seconds. For example, the first input can require a user to close a battery door or push a user input on hearing aid for at least 5 seconds up to 20 seconds, and in some implementations preferably 8-15 seconds.

At operation 215, the hearing device modifies operation of the hearing device to operate in the operation mode. After receiving the first and second inputs, the hearing device 105 enters a mode of operation. For example, the hearing device 105 can enter airplane mode where it does not transmit (or omits to transmit) wireless communication signals. As another example, the hearing device 105 can enter reduced frequency mode, where the hearing device 105 operates on a select frequency or select group of frequencies even though the hearing device 105 can operate on more frequencies. For example, the hearing device 105 can transmit wireless communication signals using a signal with a frequency from 10 to 50 MHz and stop transmitting or receiving signals using a signal with a frequency of 2.4 GHz. In such an example, the hearing device 105 can communicate with another hearing device using the select frequencies and still comply with flight requirements such as not using wireless communication devices that operate Bluetooth™ or Wi-Fi™.

Table 2 below illustrates a few examples of a first input and second input, where if the hearing device receives the first input and the second inputs, the hearing device enters a mode of operation. In some implementations, when a user pushes or toggles the first input, the first input sends a control signal to the processor 140 and the processor sends controls signals to various parts of the hearing device. In other words, the first and second inputs can produce control signals and the processor can receive, process, and retransmit these control signals. Table 3 illustrates examples of modes of operation based on first and second inputs and Table 4 illustrates examples modes of operation related to restricted frequency mode.

TABLE 2

Example First and Second Inputs for Entering Modes of Operation

| First Input | Second Input |
|---|---|
| Battery door closing (partially or completely) | Receiving extended push on user input button (e.g., 8 seconds of pushing user input) |
| Device turning on (processor receives control signal that device is on or receives signal to start up) | Within 3 minutes of turning on the device, receiving a long-push of the user input button, where a long push is greater than 8 seconds |
| Extended push of user input on hearing device | Receiving a command at a mobile device wirelessly coupled to the hearing device, where the command causes mobile device to send a signal to the hearing aid to enter a mode of operation |

TABLE 2-continued

| Example First and Second Inputs for Entering Modes of Operation | |
|---|---|
| First Input | Second Input |
| Receiving a command at a mobile device in electronic communication with a hearing device, where the command causes mobile device to send a signal to the hearing aid | After receiving the command from the mobile device, receiving a control signal from a user input at the hearing device, where the control signal indicates the hearing device should enter a mode of operation |
| Receives an input from a sensor physically coupled to the hearing aid or the user, where the sensor detects a tapping, vibration, or pressure change and transmits a control signal to the hearing device | Extended push of user input button at the hearing device |

TABLE 3

| Example Modes of Operation based on First and Second Inputs |
|---|
| Operation Mode |
| Airplane Mode |
| Restricted Frequency Mode |

TABLE 4

| Restricted Frequency Mode | |
|---|---|
| Restricted Mode On | Restricted Mode Off |
| Cannot transmit on 2.4 GHz but can transmit on any frequency between 10 to 60 MHz | Can transmit on all frequencies |
| Cannot transmit on 2.39 to 2.5 GHz, but can transmit on any frequency between 10 to 60 MHz | Can transmit on all frequencies |
| Cannot transmit on 2.4 GHz, but can transmit on 10 MHz | Can transmit on all frequencies |

At operation 220, the hearing device receives a third input to exit the operation mode for the device. As shown by the dashed lines in FIG. 2, the operation 220 is operation because the hearing device 105 can stay in an operation mode indefinitely or exit the operation mode. The third input can be: modifying a physical button, receiving a signal from a sensor unit, modifying a dial, opening or closing a battery door, modifying a remote button, modifying a remote graphical user interface, modifying a button on a touch screen for a mobile device, or receiving a signal from a pressure sensor. In some implementations, the third input is simply a repeat or the opposite of the first input. For example, if the first input was an extended push of the user input, the third input can also be an extended push of the user input. As another example, the third input can be a user with a smart phone, where the user pushes a button in a mobile application as the first input and pushes the same button at a later time as the third input. Alternatively, if first input was closing a battery door the third input can be opening a battery door.

At operation 225, the hearing device modifies operation of the device to exit the operation mode. After receiving the third input, the hearing device 105 exits a mode of operation. For example, the hearing device 105 can exit airplane mode or the reduced frequency mode. After the operation 225, the process 200 can be repeated or stopped depending on preferences of the user (e.g., if the user wants to enter airplane mode again).

Although the process or operations are presented in a given order, a device can perform alternative implementations having operations, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed or implemented in parallel, or may be performed at different times. Further any specific numbers noted herein are only examples: alternative implementations may employ differing values or ranges. Further any specific numbers noted herein are only examples: alternative implementations may employ differing values or ranges.

Additionally, although disclosure describes the hearing device 105, other electronic devices can implement the above disclosure. For example, a medical device (e.g., cochlear implant) or wearable device can implement the process 200 to enter airplane mode or a reduced frequency mode. As another example, a commercial airplane can be configured to send out a signal to all devices that are capable of receiving wireless communications. The signal can be a request to enter airplane mode, where the signal is considered a first or second input for a device.

Another implementation of the disclosed technology includes providing a sound to the user through the hearing device while an operation mode is changed. For example, a first hearing aid device provides a sound (e.g., beeping, low or high tone) through a receiver to a user for 2 minutes after the battery doors of the hearing device has been closed (e.g., indicating the device has re-booted or turned on). The sound indicates that the hearing device is enabled to enter hearing mode if the user inputs a second input. The user can enter a second input by pushing the user input button for a long period (e.g., more than 8 seconds) and then the hearing device can enter flight mode. The hearing device can also send a signal to another hearing device worn by the user to enter airplane, and after receiving this signal, the other hearing device can enter airplane mode. The other hearing device can also transmit a sound until the signal has been received. Providing an acoustic notification before, during, or after entering airplane mode has at least one benefit. Without a proper notification, a user is lost and does not know whether flight mode is activated or not. Especially: you do not know how long to keep pressing. If you user gets notified that its gesture has been recognized however, the gesture is much more usable. Now. The problem for a notification is how long because of a trade off between—being bothered by a notification which is conspicuous—and not being aware of this notification. As the mode is an exceptional mode, one could imaging providing a continuous notification up to explicit acknowledgement of the user. That is: The sequence to move in flight more. Once gesture has been recognized by the HD, the HD starts playing a notification (e.g. LED ON or HD start regularly/slowly beeping). The user acknowledges she has recognized the specific mode by pushing a button (any button)—on each HD.

CONCLUSION

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof means any connection or coupling, either direct or indirect, between two or more elements; the coupling or connection between the elements can be physical, logical, or a combination thereof. Additionally, the words "herein," "above," "below," and words of similar import, when used in this application, refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The phrases "in some implementations," "according to some implementations," "in the implementations shown," "in other implementations," and generally mean the particular feature, structure, or characteristic following the phrase is included in at least one implementation of the disclosure, and can be included in more than one implementation. In addition, such phrases do not necessarily refer to the same implementations or different implementations.

These and other changes can be made to the disclosure in light of the above Detailed Description. While the above description describes certain examples of the disclosure, and describes the best mode contemplated, no matter how detailed the above appears in text, the disclosure can be practiced in many ways. Details of the system may vary considerably in its specific implementation, while still being encompassed by the disclosure. As noted above, particular terminology used when describing certain features or aspects of the technology should not be taken to imply that the terminology is being redefined herein to be restricted to any specific characteristics, features, or aspects of the technology with which that terminology is associated. In general, the terms used in the following claims should not be construed to limit the disclosure to the specific examples disclosed in the specification, unless the above Detailed Description section explicitly defines such terms. Accordingly, the actual scope of the technology encompasses not only the disclosed examples, but also all equivalent ways of practicing or implementing the technology under the claims.

The techniques introduced here can be implemented using special-purpose hardware (e.g., circuitry), as programmable circuitry appropriately programmed with software and/or firmware, or as a combination of special-purpose and programmable circuitry. Hence, implementations may include a machine-readable medium having stored thereon instructions which may be used to program a computer (or other electronic devices) to perform a process. The machine-readable medium can include, but is not limited to, floppy diskettes, optical disks, compact disc read-only memories (CD-ROMs), magneto-optical disks, ROMs, random access memories (RAMs), erasable programmable read-only memories (EPROMs), electrically erasable programmable read-only memories (EEPROMs), magnetic or optical cards, flash memory, or other type of media/machine-readable medium suitable for storing electronic instructions. Machine-readable medium includes a non-transitory computer-readable medium storing instructions that can be executed by a processor to operate or control a device.

To reduce the number of claims, certain aspects of the technology are presented below in certain claim forms, but the applicant contemplates the various aspects of the technology in any number of claim forms. For example, while only one aspect of the technology is recited as a computer-readable medium claim, other aspects may likewise be embodied as a computer-readable medium claim, or in other forms, such as being embodied in a means-plus-function claim. Any claims intended to be treated under 35 U.S.C. § 112(f) will begin with the words "means for", but use of the term "for" in any other context is not intended to invoke treatment under 35 U.S.C. § 112(f). Accordingly, the applicant reserves the right to pursue additional claims after filing this application to pursue such additional claim forms, in either this application or in a continuing application.

What is claimed is:

1. A hearing device comprising:

a processor configured to receive control signals from a first user input and a second user input; and a memory storing instructions that when executed by the processor cause the hearing device to:

receive a first control signal that the hearing device has turned on;

after the hearing device has turned on and before a first time period has expired, receive a second control signal to enter an airplane mode for the hearing device; and activate the airplane mode for the hearing device, wherein the airplane mode:

is triggered only by receiving the first control signal before the second control signal; and prohibits the hearing device from transmitting wireless communication signals within a predetermined frequency range that is from 2.39 GHz to 2.486 GHz.

2. The hearing device of claim 1, wherein the first time period is less than 3 minutes.

3. The hearing device of claim 1, wherein the first user input is a battery door and the first control signal is received in response to the battery door closing.

4. The hearing device of claim 1, wherein the second user input is at least one of the following:

a physical button coupled to the hearing device;

a dial physically coupled to the hearing device; a remote button;

a remote graphical user interface on a mobile device wirelessly coupled to the hearing device; or a pressure sensor.

5. The hearing device of claim 1, wherein the second control signal is associated with a signal lasting from 5 to 20 seconds.

6. The hearing device of claim 1, wherein the instructions further cause the hearing device to:

provide a sound associated with entering the airplane mode after the first control signal is received and until the second control signal has been received for at least 8 seconds.

7. A method for operating a hearing device, wherein the hearing device comprises a processor configured to receive control signals from a first user input and a second user input, the method comprising:

receiving a first control signal that the hearing device has turned on;

after the hearing device has turned on and before a first time period has expired, receiving a second control signal to enter an airplane mode for the hearing device; and activating the airplane mode for the hearing device, wherein the airplane mode:

is triggered only by receiving the first control signal before the second control signal; and prohibits the hearing device from transmitting wireless communication signals within a predetermined frequency range that is from 2.39 GHz to 2.486 GHz.

8. The method of claim 7, wherein the first time period is less than 3 minutes.

9. The method of claim 7, wherein the first and second user inputs are at least one of the following:

a physical button coupled to the hearing device;

a sensor unit coupled to the hearing device;

a dial physically coupled to the hearing device;

a battery door physically coupled to the hearing device;

a remote button;

a remote graphical user interface;

a button on a touch screen for a mobile device; or a pressure sensor.

10. The method of claim 7, wherein the second user input is associated with a signal lasting from 5 to 20 seconds.

11. The method of claim 7, wherein the predetermined frequency range is associated with communicating between the hearing device and non-hearing aid devices.

12. A non-transitory computer-readable medium storing instructions that when executed by a processor cause a hearing device to perform operations, the operations comprising:

receiving a first control signal that the hearing device has turned on;

after the hearing device has turned on and before a first time period has expired, receiving a second control signal to enter an operation mode for the hearing device; and activating the operation mode for the hearing device, wherein the operation mode:

is triggered only by receiving the first control signal before the second control signal; and prohibits the hearing device from transmitting wireless communication signals within a predetermined frequency range that is from 2.39 GHz to 2.486 GHz.

13. The non-transitory computer-readable medium of claim 12, wherein:

the operation mode is associated with an airplane mode; and the airplane mode includes the hearing device operating such that the hearing device complies with wireless communication standards for an airplane during a flight, prior to a flight, or after a flight.

14. The non-transitory computer-readable medium of claim 12, wherein the first control signal is received based on a first user input that includes a battery door closing and the hearing device turning on.

15. The non-transitory computer-readable medium of claim 12, wherein the instructions further cause the hearing device to:

transmit a visual or acoustical notification that at least partially indicates the operation mode is active or is available for selection.

16. The non-transitory computer-readable medium of claim 12, wherein the predetermined frequency range has an additional frequency range that includes 10 to 50 MHz.

17. The non-transitory computer-readable medium of claim 12, wherein the second control signal is associated with a signal lasting from 5 to 20 seconds.

18. The non-transitory computer-readable medium of claim 12, wherein:

the first time period is less than 3 minutes.

* * * * *